US006868637B2

(12) United States Patent
Simon

(10) Patent No.: US 6,868,637 B2
(45) Date of Patent: Mar. 22, 2005

(54) SYSTEM FOR IMMOBILIZING A REINFORCING TUBE IN A FLEXIBLE APRON OF A HANDLING DOOR

(76) Inventor: Bernard Simon, 20 rue Jean-Baptiste Gilliard, F-69300 Caluire et Cuire (FR)

( * ) Notice: Subject to any disclaimer, the term of this patent is extended or adjusted under 35 U.S.C. 154(b) by 0 days.

(21) Appl. No.: 10/310,825

(22) Filed: Dec. 6, 2002

(65) Prior Publication Data

US 2003/0106650 A1 Jun. 12, 2003

(30) Foreign Application Priority Data

Dec. 7, 2001 (FR) ..... 01/15832

(51) Int. Cl.[7] ..... E06B 3/94
(52) U.S. Cl. ..... 52/29; 52/71; 160/84.02
(58) Field of Search ..... 52/29, 71; 160/84.01, 160/84.02, 84.11, 264

(56) References Cited

U.S. PATENT DOCUMENTS 2,201,356 A * 5/1940 Terrell ..... 160/84.02
3,292,685 A * 12/1966 Clark ..... 160/26
4,397,347 A * 8/1983 Brabant ..... 160/231.2
4,718,471 A * 1/1988 Kraeutler ..... 160/84.02
4,727,919 A * 3/1988 Kraeutler ..... 160/84.02
4,776,379 A * 10/1988 Kraeutler ..... 160/84.06
4,777,673 A * 10/1988 Patteson et al. ..... 4/558
4,828,003 A * 5/1989 Kraeutler ..... 160/84.02
4,934,437 A * 6/1990 Kraeutler ..... 160/84.02
5,038,087 A * 8/1991 Archer et al. ..... 318/469
5,078,195 A * 1/1992 Schon ..... 160/84.02
5,083,598 A * 1/1992 Schon ..... 160/84.02
5,188,160 A * 2/1993 Jelic ..... 160/84.02
5,207,256 A * 5/1993 Kraeutler ..... 160/84.02
5,246,053 A * 9/1993 Kraeutler ..... 160/84.02
5,313,998 A * 5/1994 Colson et al. ..... 160/84.02
5,394,926 A * 3/1995 Kraeutler ..... 160/264
5,542,460 A * 8/1996 McKeon ..... 160/7
5,862,850 A * 1/1999 Yang ..... 160/84.04
6,116,319 A * 9/2000 Simon ..... 160/84.01
6,152,207 A * 11/2000 Varley ..... 160/264

FOREIGN PATENT DOCUMENTS

EP 2785639 5/2000

* cited by examiner

*Primary Examiner*—Peter R. Brown
(74) *Attorney, Agent, or Firm*—Young & Thompson

(57) ABSTRACT

A handling door for an industrial building includes a flexible curtain or apron having a plurality of sheaths. A plurality of bars include one of horizontal reinforcing bars and reinforcing tubes. A hauling bar is provided. Each of the plurality of sheaths has arranged therein one of the plurality of bars. The hauling bar is arranged in one of the plurality of sheaths. A plurality of hauling straps are used for moving the flexible curtain or apron from an open position to a closed position. A plurality of strap runners cooperate with the plurality of bars and the hauling straps. A retaining and immobilizing arrangement is used. This abstract is neither intended to define the invention disclosed in this specification nor intended to limit the scope of the invention in any way.

8 Claims, 3 Drawing Sheets

SYSTEM FOR IMMOBILIZING A REINFORCING TUBE IN A FLEXIBLE APRON OF A HANDLING DOOR

CROSS-REFERENCE TO RELATED APPLICATIONS

The present application claims priority under 35 U.S.C. § 119 of French Application No. FR 01 15832, filed on Dec. 7, 2001, the disclosure of which is expressly incorporated by reference herein in its entirety.

BACKGROUND OF THE INVENTION

1. Field of the Invention

The present invention relates to a system or device for immobilizing a reinforcing tube in a flexible apron of a handling door for an industrial building.

2. Discussion of Background Information

This kind of door generally comprises a metal structure made up of a drive shaft and several horizontal reinforcing bars or reinforcing tubes which are housed, via sheaths, in the thickness of the flexible apron or curtain.

The horizontal reinforcing bars or reinforcing tubes slide in vertical slideways fixed on the vertical and opposed uprights of the handling door.

The vertical guiding slideways have a separation which is significantly greater than the width of the curtain so as to allow it to move from an open position to a closed position.

In the lower part of the flexible apron or curtain of the door and parallel to the horizontal reinforcing bars there is a hauling bar which is connected to the drive shaft by way of hauling straps which wind onto the drive shaft.

Some horizontal reinforcing bars or reinforcing tubes bear connecting or guiding means which are formed as flexible devices as described, for example, in French patent FR 98 14301 (2 785 639) in the name of the Applicant, the disclosure of which is expressly incorporated by reference in its entirety.

These flexible connecting devices are designed to connect the hauling or safety straps freely to the corresponding horizontal reinforcing bars or reinforcing tubes to allow the flexible apron or curtain of the handling door to be raised evenly.

To fit the flexible connecting devices, it is noted that housings or openings are cut from the thickness of the sheaths of the flexible apron or curtain in the region of the corresponding horizontal reinforcing bars.

The flexible connecting devices are identical in their configuration however many horizontal reinforcing bars there are, that is to say that the same flexible connecting device is found on the horizontal reinforcing bar situated at the bottom of the curtain as on the horizontal reinforcing bar placed at the top of the curtain.

Thus, the hauling strap, when the door is in the open position, lifts the hauling bar which, as it travels upward, comes into contact with the horizontal reinforcing bar just above it to drive it vertically and so on up to the horizontal reinforcing bar situated at the top of the curtain.

In the door-raising movement, the widths of the curtain which are situated between two horizontal reinforcing bars fold and stack up on one another to form a concertina of fabric.

Horizontal tubes or breaker tubes which may or may not be free with respect to the hauling strap may be inserted between the horizontal reinforcing bars. The function of the breaker tubes is to form and maintain the fold of the curtain between two contiguous horizontal reinforcing bars while the door is in its opening movement.

When the flexible curtain moves vertically, it is found that the horizontal reinforcing bars may slide within the sheaths, damaging the ends thereof when these are closed.

It is also found that the ends of the horizontal reinforcing bars may emerge from the sheaths of the flexible apron or curtain and rub on and damage the vertical walls of the guiding slideways and of the vertical uprights of the handling door.

SUMMARY OF THE INVENTION

The handling door and the immobilizing device according to the present invention are intended to avoid the horizontal reinforcing bars or tubes moving inside the sheaths of the flexible apron or curtain of the handling door.

The handling door for an industrial building according to the present invention comprises a flexible curtain or apron in which horizontal reinforcing bars or reinforcing tubes are retained in mutually parallel sheaths. A hauling bar is also retained in a sheath. A drive shaft is driven in rotation by a geared motor unit. Hauling straps are provided for moving the flexible curtain from an open position to a closed position. Strap runners collaborate and/or cooperate with the reinforcing bars and the hauling straps. Vertical uprights are secured to guiding slideways. An arrangement for retaining and immobilizing the horizontal reinforcing bars inside the sheaths is provided where the reinforcing bars meet the strap runners.

The handling door for an industrial building according to the present invention comprises a retaining and immobilizing arrangement which includes recesses made in the horizontal reinforcing bars.

The handling door for an industrial building according to the present invention comprises reinforcing bars which have recesses which are produced at the cutouts made in the sheaths to allow connection with the strap runners.

The handling door for an industrial building according to the present invention comprises reinforcing bars with recesses, the outside diameter of which are smaller than the outside diameter of the reinforcing bars.

The handling door for an industrial building according to the present invention comprises strap runners which each include a link provided at one of its ends with a first loop collaborating with a recess of a first horizontal reinforcing bar and at the other end with a second loop collaborating with another recess of a second horizontal reinforcing bar located in close proximity to the first.

The handling door for an industrial building according to the present invention comprises strap runners each link of which comprises, between each loop, a ring through which the corresponding hauling strap passes.

The retaining and immobilizing arrangement according to the present invention comprises recesses made in the reinforcing bars of the handling door.

The retaining and immobilizing arrangement according to the present invention comprises recesses which are produced at cutouts made in the sheaths of the flexible curtain to allow connection with strap runners of the handling door.

The retaining and immobilizing arrangement according to the present invention comprises recesses which have an outside diameter which is smaller than the outside diameter of the reinforcing bar.

The invention also provides a handling door for an industrial building comprising a flexible curtain or apron having a plurality of sheaths. A plurality of bars are provided which comprise one of horizontal reinforcing bars and reinforcing tubes. A hauling bar is utilized. Each of the plurality of sheaths have arranged therein one of the plurality of bars. The hauling bar is arranged in one of the plurality of sheaths. A plurality of hauling straps are used for moving the flexible curtain or apron from an open position to a closed position. A plurality of strap runners cooperate with the plurality of bars and the hauling straps. A retaining and immobilizing arrangement is provided.

The retaining and immobilizing arrangement may comprise at least one of recesses formed in at least two of the plurality of bars and cutouts formed in at least two of the plurality of sheaths.

The retaining and immobilizing arrangement may comprise at least one of recesses formed in at least two of the plurality of bars and cutouts formed in at least two of the plurality of sheaths.

The retaining and immobilizing arrangement may comprise at least one of recesses formed in each of the plurality of bars and cutouts formed in each of the plurality of sheaths.

The handling door may be adapted to cooperate with vertical uprights secured to guiding slideways. At least one of the plurality of bars may be coupled to at least one of the plurality of strap runners. At least two of the plurality of bars may be coupled to at least one of the plurality of strap runners. The handling door may be adapted to open and close via a shaft driven in rotation by a geared motor unit. Each of the plurality of bars may comprise a retaining and immobilizing arrangement. Each retaining and immobilizing arrangement may comprise a plurality of recesses. Each of the plurality of recesses may be arranged adjacent a cutout that is formed in the plurality of sheaths, whereby one of the recesses and one of the cutouts allow one of the plurality of strap runners to be connected to one of the plurality of bars. Each of the plurality of recesses may be arranged adjacent a cutout that is formed in the plurality of sheaths, whereby each of the recesses and each of the cutouts allow each of the plurality of strap runners to be connected to each of the plurality of bars. At least one of the plurality of recesses may have an outside diameter which is smaller than an outside diameter of one of the plurality of bars. Each of the plurality of recesses may have an outside diameter which is smaller than an outside diameter of each of the plurality of bars.

At least one of the plurality of strap runners may be a flexible strap runner. At least one of the plurality of strap runners may comprise a link which includes a first loop and a second loop. The first loop may cooperate with a recess arranged in one of the plurality of bars and the second loop may cooperate with another recess arranged in another of the plurality of bars. The first loop may cooperate with a recess arranged in one of the plurality of bars and the second loop may cooperate with another recess arranged in an adjacent one of the plurality of bars.

At least one of the plurality of strap runners may comprise a link which includes a first loop, a second loop and a ring arranged therebetween. The ring may receive at least one of the plurality of hauling straps.

The invention also provides for a handling door for an industrial building comprising a flexible curtain or apron having a plurality of sheaths. A plurality of bars comprise one of horizontal reinforcing bars and reinforcing tubes. A hauling bar is provided. Each of the plurality of sheaths have arranged therein one of the plurality of bars. The hauling bar is arranged in one of the plurality of sheaths. A plurality of strap runners connect adjacent pairs of the plurality of bars together. A plurality of hauling straps are used for moving the flexible curtain or apron from an open position to a closed position. At least one of the plurality of hauling straps is coupled to each of the plurality of strap runners. At least one of the plurality of bars comprises recesses. At least one of the plurality of sheaths comprises cutouts.

The invention also provides for a handling door for an industrial building comprising a flexible curtain or apron having a plurality of sheaths. A plurality of bars comprises one of horizontal reinforcing bars and reinforcing tubes. A hauling bar is provided. Each of the plurality of sheaths have arranged therein one of the plurality of bars. The hauling bar is arranged in one of the plurality of sheaths. A plurality of strap runners connect adjacent pairs of the plurality of bars together. A plurality of hauling straps are utilized for moving the flexible curtain or apron from an open position to a closed position. Each of the plurality of hauling straps is coupled to a row strap runner. Each of the plurality of bars comprises recesses and each of the plurality of sheaths comprises cutouts.

BRIEF DESCRIPTION OF THE DRAWINGS

Other advantages and characteristics of the present invention will become apparent upon reading the following description, which is only provided by way of non-limiting example, with reference to the annexed drawings, in which.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
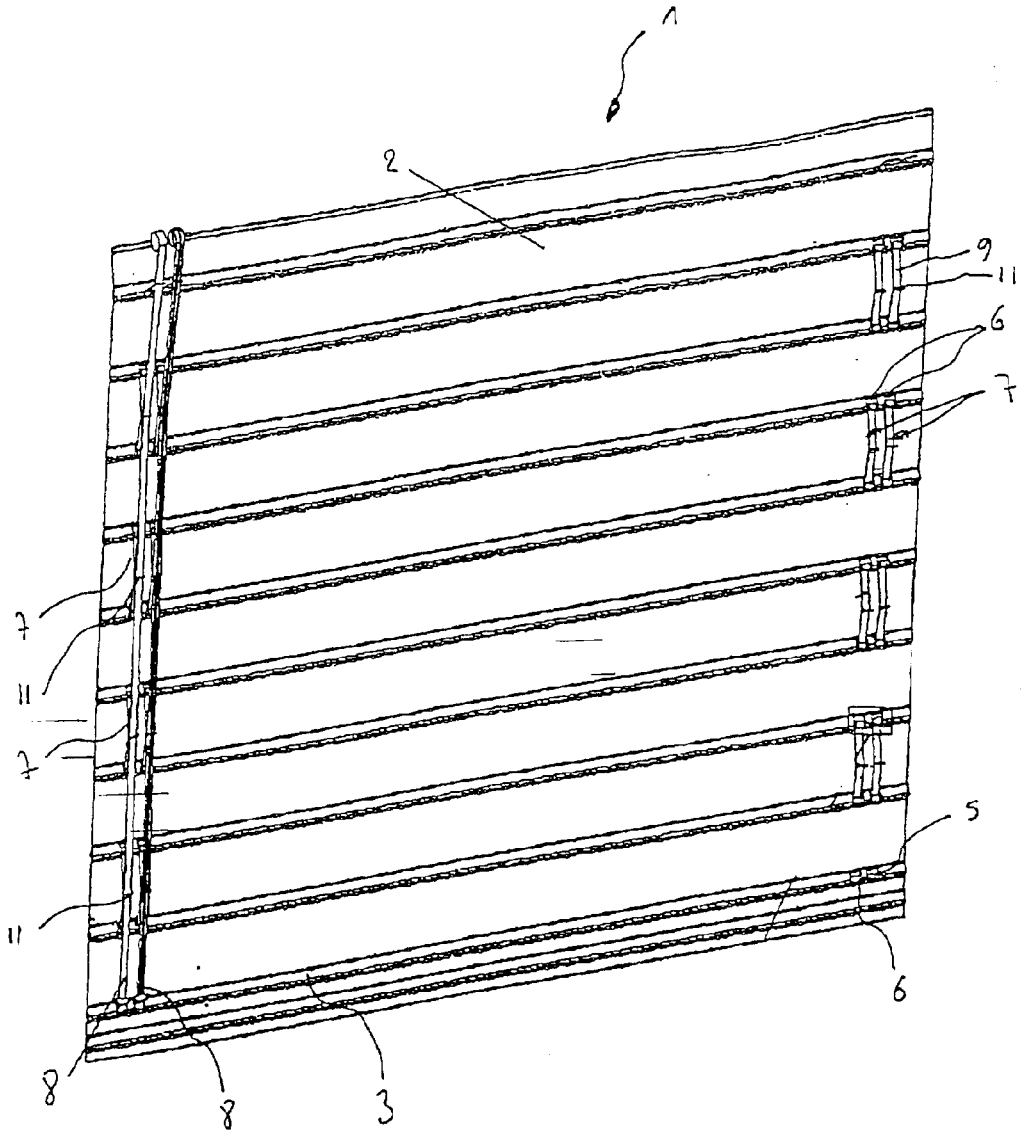
FIG. 1 is a perspective view showing the flexible apron or curtain of a handling door for an industrial building.

FIG. 1 depicts a handling door 1 which comprises a flexible curtain 2 provided with mutually parallel sheaths 3 in which horizontal reinforcing bars or reinforcing tubes 4 and a hauling bar 5 are placed.

The door 1 comprises, in a way known per se, a drive shaft driven in rotation by a geared motor unit, vertical uprights and guiding slideways, the uprights and slideways not being depicted.

The horizontal reinforcing bars 4 and the hauling bar 5 are housed in the sheaths 3 which are made in the thickness of the flexible curtain 2. The sheaths 3 are arranged at even distances from one another over the entire height of the flexible curtain 2.

The sheaths 3 accommodating the horizontal reinforcing bars 4 comprise cutouts 6 allowing the fitting of flexible strap runners 7 connecting the reinforcing bars 4 together in pairs.

Also, the sheath 3 accommodating the hauling bar 5 comprises cutouts 6 allowing the fixing around the bar of hauling straps 8 which are connected at their opposite ends to the drive shaft of the handling door 1.

The hauling straps 8 are connected to each horizontal reinforcing bar 4 lying between the drive shaft via the flexible strap runners 7.

Each flexible strap runner 7 comprises a link 9 provided at one of its ends with a first loop 10 which collaborates or cooperates with a first horizontal reinforcing bar 4 and at the other end with a second loop 10 which collaborates or cooperates with another horizontal reinforcing bar 4 located just below the first.

The link 9 is secured, between the loops 10, to a ring 11 through which the corresponding hauling strap 8 passes, to allow the horizontal reinforcing bars 4 to move vertically.

Figure 2:
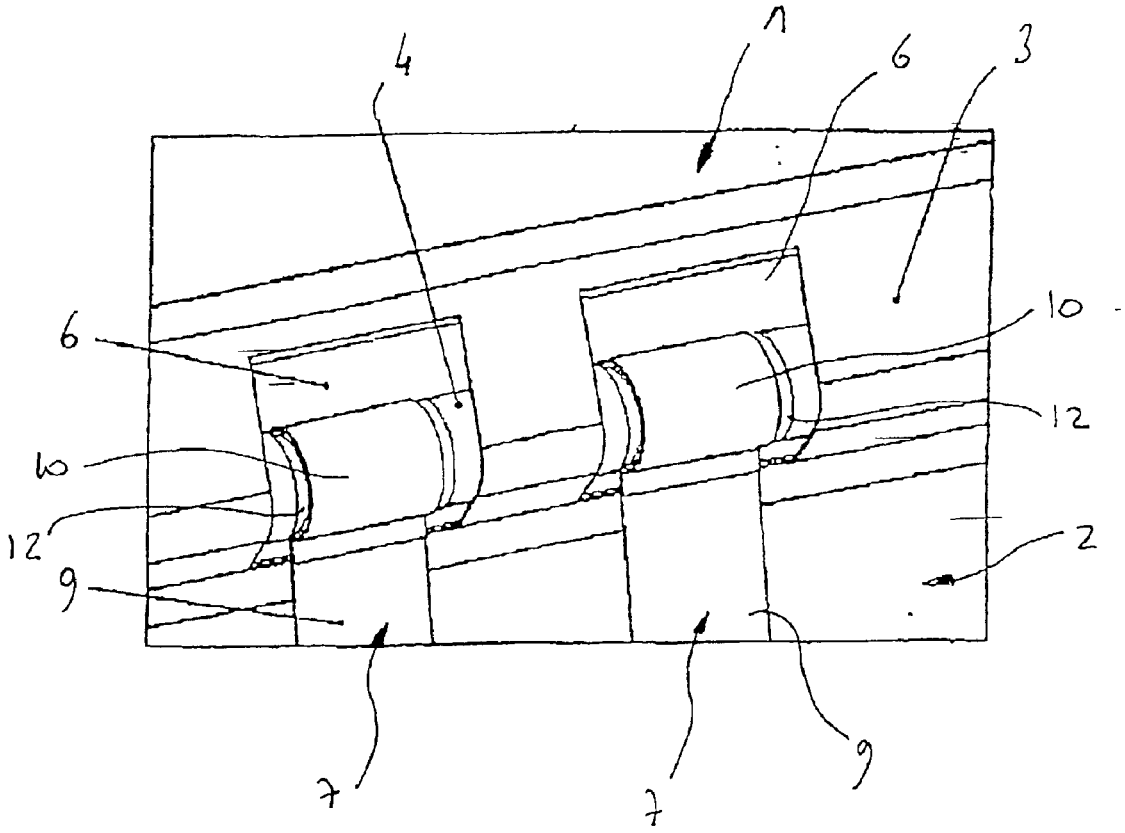
FIG. 2 is a detail view illustrating the device for immobilizing a reinforcing bar or tube in the flexible apron or curtain of a handling door for an industrial building.
Figure 3:
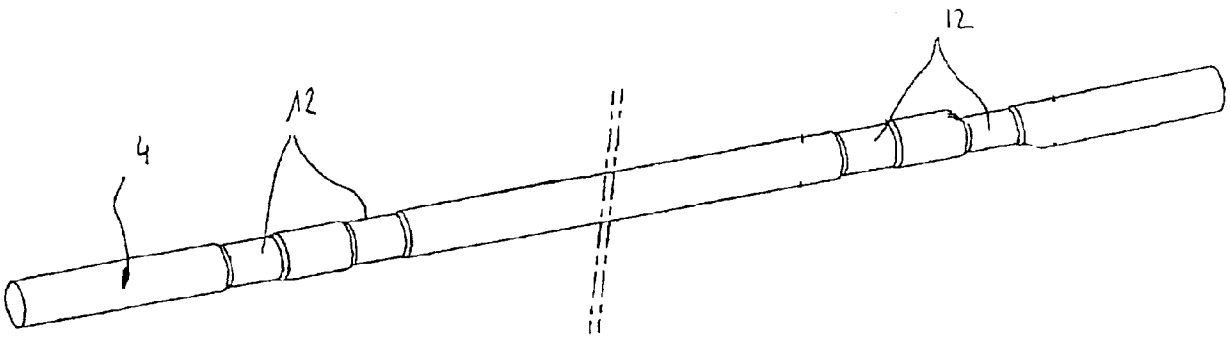
FIGS. 3 and 4 are views showing the reinforcing bar or tube provided with the immobilizing device according to the present invention.
Figure 4:
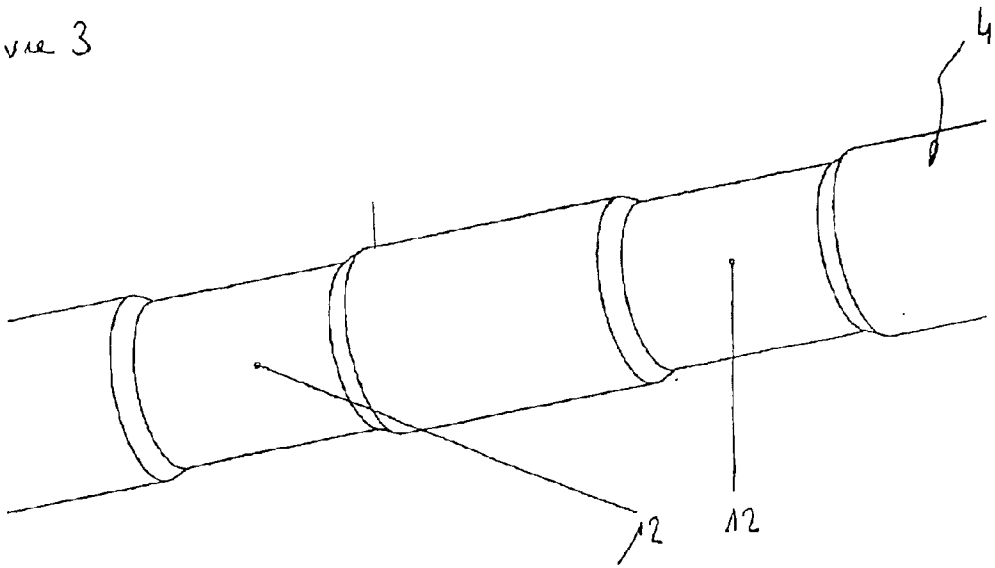

FIGS. 2 to 4 show a horizontal reinforcing bar or reinforcing tube 4 of a handling door 1 comprising, on its periphery, a retaining and immobilizing device which includes recesses 12.

The recesses 12 are given an outside diameter which is smaller than the outside diameter of the reinforcing bar 4.

The recesses 12 are produced on the reinforcing bar 4 at the cutouts 6 made in the corresponding sheath 3.

The recesses 12 are of a suitable width so that they can accommodate the corresponding loop 10 of the link 9 of each strap runner 7, to allow, on the one hand, retention of the reinforcing bar 4 in its sheath 3 and, on the other hand, retention of the link 9 with respect to the reinforcing bar 4.

Also, the link 9 of each strap runner 7 is retained laterally with respect to the flexible curtain or apron 2 by way of the vertical edges of each cutout 6 made in the sheaths 3.

Thus, each link 9 is arranged in such a way that each loop 10 is housed in each recess 12 of the corresponding horizontal reinforcing bar 4 so as to prevent lateral movement of the bar within the corresponding sheath 3.

It is noted that the strap runners 7 collaborate or cooperate with the hauling straps 8 which are held between the hauling bar 5 and the drive shaft of the handling door 1.

During movements of the flexible curtain or apron 2 from an open position to a closed position the strap runners 7 pull the horizontal reinforcing bars 4 which are held firm by the strap runner at each recess 12.

Immobilizing each horizontal reinforcing bar 4 inside the corresponding sheaths 3 makes it possible to avoid damage to the latter at their ends in the region of the uprights and guiding slideways of the handling door 1.

Also, it is found that the ends of the horizontal reinforcing bars 4 can no longer rub against the guiding slideways and the vertical walls of each upright of the handling door 1.

Each horizontal reinforcing bar 4 comprises a number of recesses 12 which depends on the number of strap runners 7 or hauling straps 8 provided for moving the flexible curtain or apron 2 of the handling door vertically.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A handling door for an industrial building, comprising:

a flexible curtain or apron having a plurality of parallel sheaths, each having a plurality of cut-outs therein;

a plurality of reinforcing bars or tubes extending horizontally through a respective one of said plural sheaths;

a hauling bar extending through one of said plural sheaths;

a plurality of hauling straps that move the flexible curtain from an open position to a closed position;

a plurality of strap runners connecting adjacent ones of said plural reinforcing bars; and means for retaining and immobilizing the plural reinforcing bars within respective sheaths, said means for retaining and immobilizing comprising recesses in each of said plural reinforcing bars, each of said recesses is aligned with a respective one of said plural cut-outs so that a respective one of said strap runners is within a respective one of said recesses and through a corresponding one of said cut-outs.

2. The handling door according to claim 1, wherein each recess has a smaller outside diameter than an outside diameter of the plural reinforcing bars.

3. The handling door as claimed in claim 1, wherein each strap runner comprises a link having a first loop at a first end of said strap runner, said first loop encircling a first one of said reinforcing bars and being within a recess of said first one of said reinforcing bars, and a second loop at a second end of said strap runner, said second loop encircling a second one of said reinforcing bars and being within a recess of said second one of said reinforcing bars, said first and second reinforcing bars being directly adjacent.

4. The handling door as claimed in claim 3, wherein the link comprises, between each loop, a ring through which a respective one of said hauling straps passes.

5. The handling door as claimed in claim 1, further comprising a driving shaft driven in rotation by a geared motor, said hauling straps rolling about said driving shaft.

6. The handling door as claimed in claim 1, further comprising vertical uprights secured to guiding slideways to guide the door.

7. A handling door for an industrial building, comprising:

a flexible curtain or apron having a plurality of sheaths, each of said plural sheaths having at least one cut-out therein;

a plurality of reinforcing bars or tubes extending through a respective one of said plural sheaths;

a hauling bar extending through one of said plural sheaths;

at least one hauling strap that is driven by a driving shaft that is in turn driven in rotation by a geared motor so that the flexible curtain moves from an open position to a closed position along vertical uprights secured to guiding slideways that guide the curtain; and a plurality of strap runners connected between said plural reinforcing bars;

wherein each of the plural reinforcing bars has at least one recess therein, and wherein a respective recess is aligned with a respective cut-out so that one of said strap runners is connected to two of said plural reinforcing bars at a respective recess and through a corresponding cut-out.

8. A handling door for an industrial building, comprising:

a flexible curtain having a plurality of parallel sheaths;

a plurality of reinforcing bars extending through a respective one of said plural sheaths;

a hauling bar extending through one of said plural sheaths;

a plurality of hauling straps connected to said hauling bar that move the flexible curtain from an open position to a closed position;

a plurality of strap runners connecting at least two of said plural reinforcing bars to each other; and means for retaining and immobilizing the plural reinforcing bars within respective sheaths.

* * * * *